US011808408B2

(12) United States Patent
Tilhof

(10) Patent No.: US 11,808,408 B2
(45) Date of Patent: Nov. 7, 2023

(54) FITTING FOR LIQUID GAS BOTTLES

(71) Applicant: CleanTech Swiss AG, Wollerau SZ (CH)

(72) Inventor: Eckhard Tilhof, Wangen (CH)

(73) Assignee: CleanTech Swiss AG, Wollerau SZ (CH)

( * ) Notice: Subject to any disclaimer, the term of this patent is extended or adjusted under 35 U.S.C. 154(b) by 139 days.

(21) Appl. No.: 17/268,367

(22) PCT Filed: Aug. 13, 2019

(86) PCT No.: PCT/EP2019/071657
§ 371 (c)(1),
(2) Date: Feb. 12, 2021

(87) PCT Pub. No.: WO2020/035473
PCT Pub. Date: Feb. 20, 2020

(65) Prior Publication Data

US 2021/0341108 A1 Nov. 4, 2021

(30) Foreign Application Priority Data

Aug. 14, 2018 (EP) ..... 18189019
Oct. 24, 2018 (DE) ..... 202018106076.7

(51) Int. Cl.
*F17C 13/04* (2006.01)

(52) U.S. Cl.
CPC ..... *F17C 13/04* (2013.01); *F17C 2201/056* (2013.01); *F17C 2205/0329* (2013.01);
(Continued)

(58) Field of Classification Search
CPC ..... Y10T 137/86332; F17C 2205/0329; F17C 2201/056; F17C 2205/0332;
(Continued)

(56) References Cited

U.S. PATENT DOCUMENTS 5,305,794 A * 4/1994 George ..... F17C 13/04 251/117
5,520,214 A * 5/1996 Mack ..... G05D 7/0126 137/505.34

(Continued)

FOREIGN PATENT DOCUMENTS

| | | |
|---|---|---|
| DE | 4334182 | 4/1995 |
| EP | 3021033 | 5/2016 |
| EP | 3021034 | 5/2016 |

OTHER PUBLICATIONS

Machine Translation of DE4334182A1 retrieved from espacenet.com on Oct. 2022 (Year: 2022).*

(Continued)

*Primary Examiner* — Jessica Cahill
(74) *Attorney, Agent, or Firm* — Renner, Otto, Boisselle & Sklar, LLP

(57) ABSTRACT

A fitting for a liquid gas bottle with a gas consumer connection piece, with a gas inlet opening on the underside, with a gas conducting connection between the gas inlet opening and the gas consumer connection piece, with a rotary handle, which can be turned into an open position and into a closed position, wherein in the open position gas can flow from the gas inlet opening to the gas consumer connection piece and in the closed position no gas can flow from the gas inlet opening to the gas consumer connection piece, with a closable opening on the upper side of the fitting, with a gas conducting connection which connects the closable opening on the upper side with an opening at the underside in such a way that refilling a connected gas bottle with gas through the underside and through the closable opening is possible, characterized in that the edge of the closable opening is part of the rotary handle.

22 Claims, 5 Drawing Sheets

Figure 1:
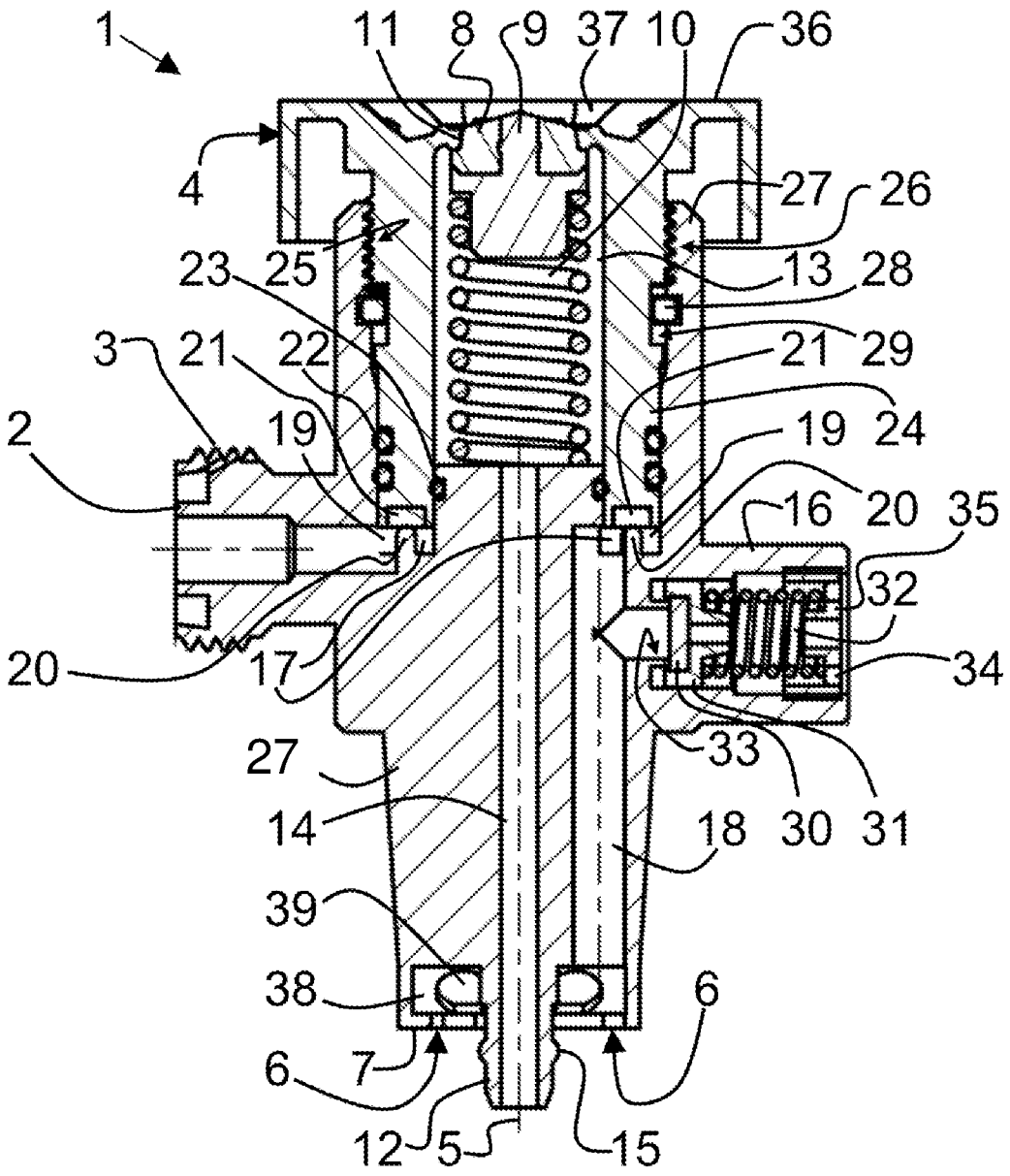

(52) U.S. Cl.
CPC ..... *F17C 2205/0332* (2013.01); *F17C 2205/0335* (2013.01); *F17C 2205/0338* (2013.01); *F17C 2205/0385* (2013.01); *F17C 2223/0153* (2013.01); *F17C 2223/035* (2013.01); *F17C 2260/028* (2013.01)

(58) Field of Classification Search
CPC ..... F17C 2205/0335; F17C 2205/0338; F17C 2205/0385; F17C 2223/0153; F17C 2223/035; F17C 2260/028; F17C 13/04
See application file for complete search history.

(56) References Cited

U.S. PATENT DOCUMENTS

2008/0035221 A1* 2/2008 Gawryjolek ..... G05D 7/0126 137/613
2009/0301494 A1* 12/2009 Rehberg ..... G05D 16/107 128/205.24
2010/0263747 A1* 10/2010 Kremer ..... F16K 1/306 137/561 R
2011/0094608 A1* 4/2011 Lane, III ..... F17C 13/04 137/558
2017/0314733 A1 11/2017 Tilhof
2017/0328490 A1* 11/2017 Muzzo ..... F17C 13/04
2017/0350559 A1 12/2017 Tilhof

OTHER PUBLICATIONS

European Patent Office, International Search Report and Written Opinion of corresponding PCT Application No. PCT/EP2019/071657, dated Sep. 24, 2019 and English Translation.
International Preliminary Report on Patentability for corresponding International Patent Application No. PCT/EP2019/071657 dated Feb. 16, 2021.

* cited by examiner

FITTING FOR LIQUID GAS BOTTLES

This application is a national phase of International Application No. PCT/EP2019/071657 filed Aug. 13, 2019, which claims priority to European Application No. 18189019.5 filed Aug. 14, 2018 and German Patent Application No. 202018106076.2 filed Oct. 24, 2019, all of which are hereby incorporated herein by reference.

The invention relates to a fitting for liquid gas bottles and a method for refilling with liquid gas.

A gas bottle is a pressure vessel, usually made of metal, regularly made of steel, for the transport and storing of gases under pressure. Such a bottle can have a volume of more than 100 liters. The nominal pressure can be several hundred bar.

Liquid gas bottles contain gases such as LPG in liquefied form. Common gases are ethane, propane, butane and mixtures thereof. These gases can be liquefied at room temperature by comparatively low pressure. The liquid gas content of such bottles is usually between 3 and 33 kg. The height of such liquid gas bottles is usually between 420 mm and 1290 mm. The bottle diameter is typically between 200 mm and 318 mm.

Liquid gas bottles are closed with a fitting, to which a suitable hose line can be screwed, usually in connection with a pressure reducer, for controlled withdrawal of their contents. In addition, a safety valve is located in the fitting of liquid gas bottles which limits the permissible overpressure in the bottle to, for example, approx. 30 bar to prevent the bottle from bursting.

Typically, a fitting of such a liquid gas bottle has a lateral connection piece as a gas tap, which is used for filling as well as for withdrawal. Lines are manually screwed onto this gas tap both in the case of withdrawal and refilling. When the gas tap is open, the lateral connection piece is connected to an opening at the underside of the fitting. This underside with the opening is located above the liquid level when a liquid gas bottle is installed. Therefore, when gas is withdrawn, the gas which is above the liquid level in the gaseous state is withdrawn.

Liquid gas bottles are used for the operation of gas consumers such as gas stove, gas cooker, gas grill, gas oven or gas radiant heaters. When the content of a liquid gas bottle is used up, liquid gas bottles are returned by the consumer to the point of sale of liquid gas bottles for refilling. After such a return of the liquid gas bottle, it is transported from the point of sale to a central filling machine or filling station.

In order to facilitate refilling, it is known from publication DE 43 34 182 A1 that in addition to a lateral connection piece or lateral gas tap, a centric filling point can be provided. Filling can then be carried out from above without the need to align a laterally protruding gas tap.

From the publication EP 3021034 A1 a fitting is known, which has a gas tap for gas withdrawal and an opening for refilling a liquid gas bottle. The opening for refilling a liquid gas bottle can be connected in a gas conducting manner to a tubular or hose line of the fitting by opening a tap, which should extend at least 300 mm, preferably at least 400 mm, into a liquid gas bottle, when the fitting is connected to such a gas bottle. This ensures that the line can extend into the liquefied part of the gas, which above all enables very fast emptying by pumping out.

It is the task of the invention to reduce the technical effort for refilling gas bottles.

To solve the task, a fitting comprises the features of the first claim. Advantageous embodiments result from the dependent claims.

The fitting for a liquid gas bottle according to the invention comprises a gas consumer connection piece. A gas consumer can be connected to the gas consumer connection piece to supply the gas consumer with gas. In particular, the gas consumer connection piece has a thread through which a gas consumer can be connected by means of a screw connection. In particular, the gas consumer connection piece stands out of the fitting laterally.

There is a gas inlet opening at an underside of the fitting and a gas conducting connection between the gas inlet opening and the gas consumer connection piece. Gas from a gas bottle connected to the fitting can pass through the gas inlet opening to the gas consumer connection piece to supply gas to a gas consumer.

The fitting comprises a rotary handle that can be rotated to an open position and a closed position. In an open position gas can flow from the gas inlet opening to the gas consumer connection piece. In the closed position, no gas can flow from the gas inlet opening to the gas consumer connection piece.

The fitting has a closable opening on its upper side for refilling. Closable opening means that there is an opening and also a closing device that, when closed, prevents gas from flowing through this opening into a gas bottle connected to the fitting. In particular, the closable opening is closed by an valve that can be operated from the outside to open the valve. In particular, the valve can be opened by pressure.

There is a gas conducting connection, which connects the closable opening with an opening at the underside of the fitting in such a way that a refilling of a connected gas bottle with gas through the closable opening is possible.

In a preferred embodiment, the rotary handle comprises the closable opening through which a gas bottle can be refilled. The edge of the closable opening, also called opening edge, is therefore part of the rotary handle. In particular, the opening enables an automated refilling using a filling station as described in EP 3 021 033 A1. The number of parts required is low, especially in comparison to the prior art as described in publication DE 43 34 182 A1 and publication EP 3 021 034 A1, according to which a separate component is arranged for the provision of an opening on the upper side. The installation space can be kept small.

In order to be able to refill a gas bottle in an automated manner with little technical effort, the closable opening provided for refilling is located on the upper side of the fitting. In particular, this keeps the effort for positioning a gas bottle in the filling station low. If the rotary handle is now also located on the upper side, then a filling station can not only refill a gas bottle connected to the fitting from above with little centering effort, but can also open and close the rotary handle in an automated manner from above without the need for additional effort for positioning a gas bottle. In addition, a fitting can be built with less technical effort compared to the fitting known from EP 3 021 034 A1. Nevertheless, the rotary handle can be closed in an automated manner in a technically simple manner if necessary when a gas bottle is to be refilled.

The rotary handle advantageously comprises an inner cylinder which forms an upper portion of the gas conducting connection connecting the closable opening on the upper side with the opening at the underside. This contributes to the fact that the fitting can be manufactured with a small number of components as well as with little installation space.

The rotary handle comprises in particular a cap which is connected to the cylinder in one piece. Thus, the rotary handle can consist of metal, wherein the cap and cylinder are manufactured in one piece by machining a metal block. The rotary handle is therefore not composed of several parts that were initially manufactured individually. This also reduces the number of parts required for production.

In the inner cylinder, preferably, a closing device is provided with which the closable opening can be closed. The closing device is formed in particular by a valve which can be moved from the outside by pressure against the force of a spring, thereby opening the opening. This facilitates automated refilling. The lower end of the valve is in particular supported against the housing of the fitting.

The upper end of the valve is for example clamped to the closing device or the valve of the closing device. A part of the closing device reaches into a spring which is spiral, for example, which is held by the upper region of the spring, e.g. in a form-fit manner and/or clamping.

In an advantageous embodiment, the inner cylinder separates an inner channel from an outer channel in a gastight manner when the rotary handle is in its closed position. Gas can flow from the inner channel into the outer channel when the rotary handle is in its open position. Gas can then flow from the gas inlet opening on the underside along a gas supply channel into the inner channel. Gas can also flow from the outer channel to the gas consumer connection piece. This embodiment allows the fitting to be manufactured with a small number of components in a small installation space.

The inner channel and the outer channel run preferably annularly around the gas conducting connection, which connects the closable opening on the upper side with the opening at the underside. The available installation space is thus used particularly well to bring gas from a connected bottle to a consumer. In particular, outer channel and inner channel are located on the same plane. The inner channel is preferably located inside the outer channel. Also these embodiments contribute to being able to manufacture with a small number of components and with little installation space.

Lifting movements of the inner cylinder are preferably performed by a rod, bolt or retaining ring that extends into a recess. The recess is wider than the rod, bolt or retaining ring such that the rod, bolt or retaining ring can be moved along the recess. The rod, bolt or retaining ring can consist of metal or plastic. The retaining ring can be a sealing ring by which desired gas-tight connections which can prevent unplanned gas leakage can advantageously be ensured in an improved manner.

The gas supply channel is preferably provided with a pressure relief valve, through which gas can escape from the fitting in event of excessive gas pressure. A connected gas bottle is thus protected from an excessive overpressure.

Preferably the pressure relief valve is arranged on a side of the fitting opposite the gas consumer connection piece. This arrangement allows the fitting to be manufactured compactly in a small space.

Advantageously, a riser connection piece protrudes with respect to the underside. Gas can flow through the riser connection piece to the closable opening. A riser or hose can be easily attached to the riser connection piece. It is thus possible to select a riser or a hose that reaches to the bottom of a connected gas bottle. This facilitates and accelerates the emptying of a gas bottle during an automatic refill.

The underside is preferably bordered by an interior space in which an external filling protection is present. The external filling protection preferably runs at least partially at an angle inside the interior space. The external filling protection prevents the filling of the gas bottle through the gas consumer connection piece. It functions like a check valve. Gas can flow from the interior space to the gas consumer connection piece when the rotary handle is opened.

Between the inner cylinder and the housing of the fitting which is inwardly and/or outwardly adjacent to the inner cylinder there are advantageously one or more sealing rings, which for example are held in recesses. The one or more sealing rings are pressed in a gas-tight manner against the inner cylinder. The sealing rings consist in particular of an elastomer or another resilient plastic.

The fitting housing is preferably made of metal. A sufficiently stable fitting housing can be manufactured with little technical effort.

The fitting housing is preferably made of one piece. The number of components can thus be kept low. Also the effort for the production is low, because it is not necessary to produce several parts individually first and to join them together to a fitting housing afterwards. Instead, the fitting housing can be machined from a block, for example by milling and/or drilling. Such one-piece production also avoids tightness problems.

The rotary handle is in particular connected to the fitting housing by a threaded connection. A lower portion of the gas conducting connection which connects the closable opening on the upper side with the opening at the underside, is formed by the fitting housing. This also contributes to the fact that the fitting can be manufactured from only a few parts.

The fitting housing preferably comprises the underside to further reduce the number of parts needed.

The gas consumer connection piece, the pressure relief valve piece and/or the riser connection piece are preferably also part of the fitting housing to keep the number of parts low.

Preferably, the rotary handle comprises a cap with a funnel-like hollow. The closable opening is located in the bottom of the cavity. This facilitates automatic refilling of a gas bottle. The hollow is in particular formed by ridges that extend from one edge of the cap towards the closable opening. A space remains between the ridges into which a tool can reach. This makes it easier to operate the rotary handle in an automated manner. Also the ridges are advantageously connected to the cap in one piece. The cap is thus machined from one piece to further reduce the number of parts.

Reducing the number of parts allows to keep production costs low.

Figure 2:
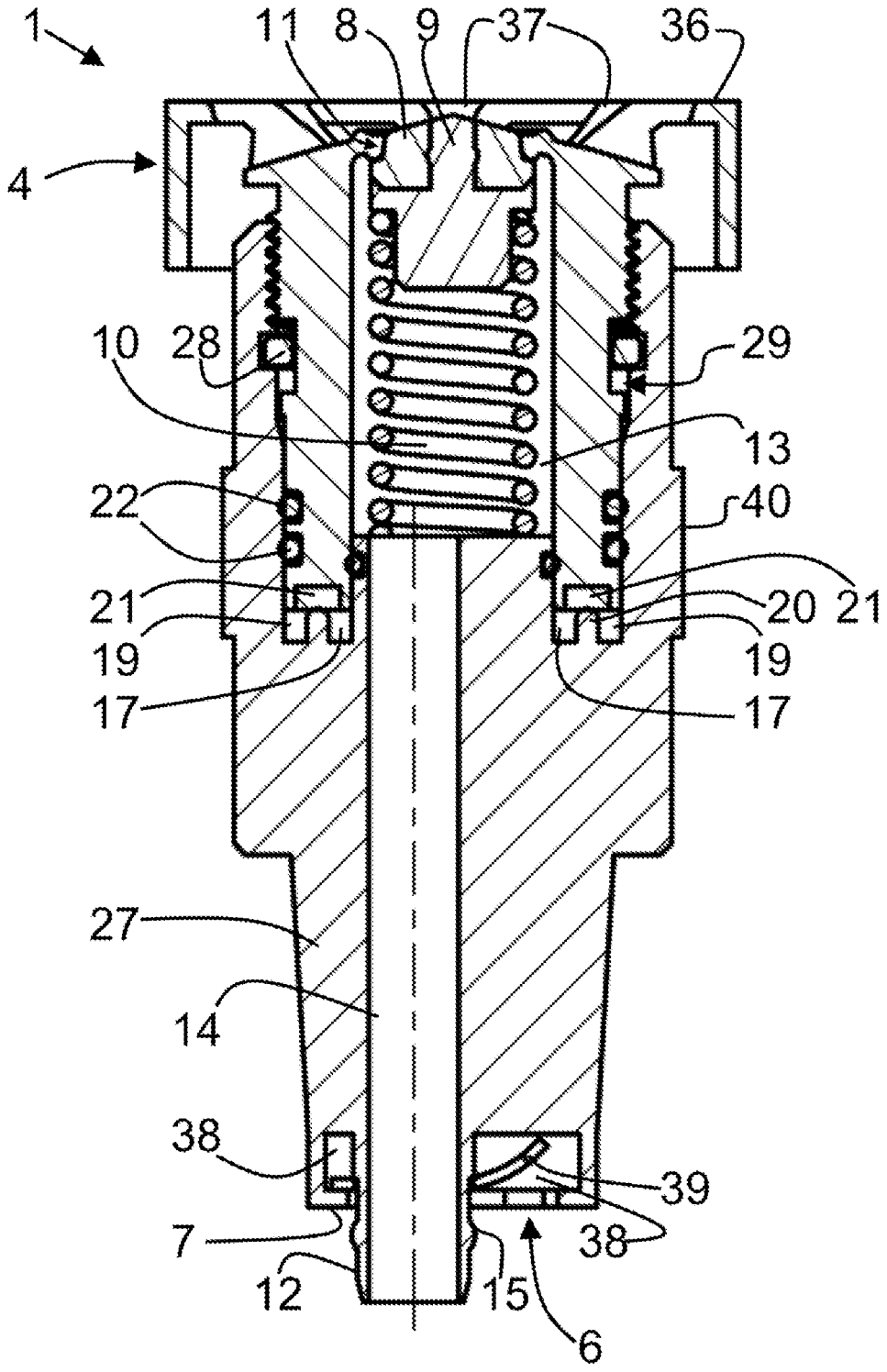
Figure 3:
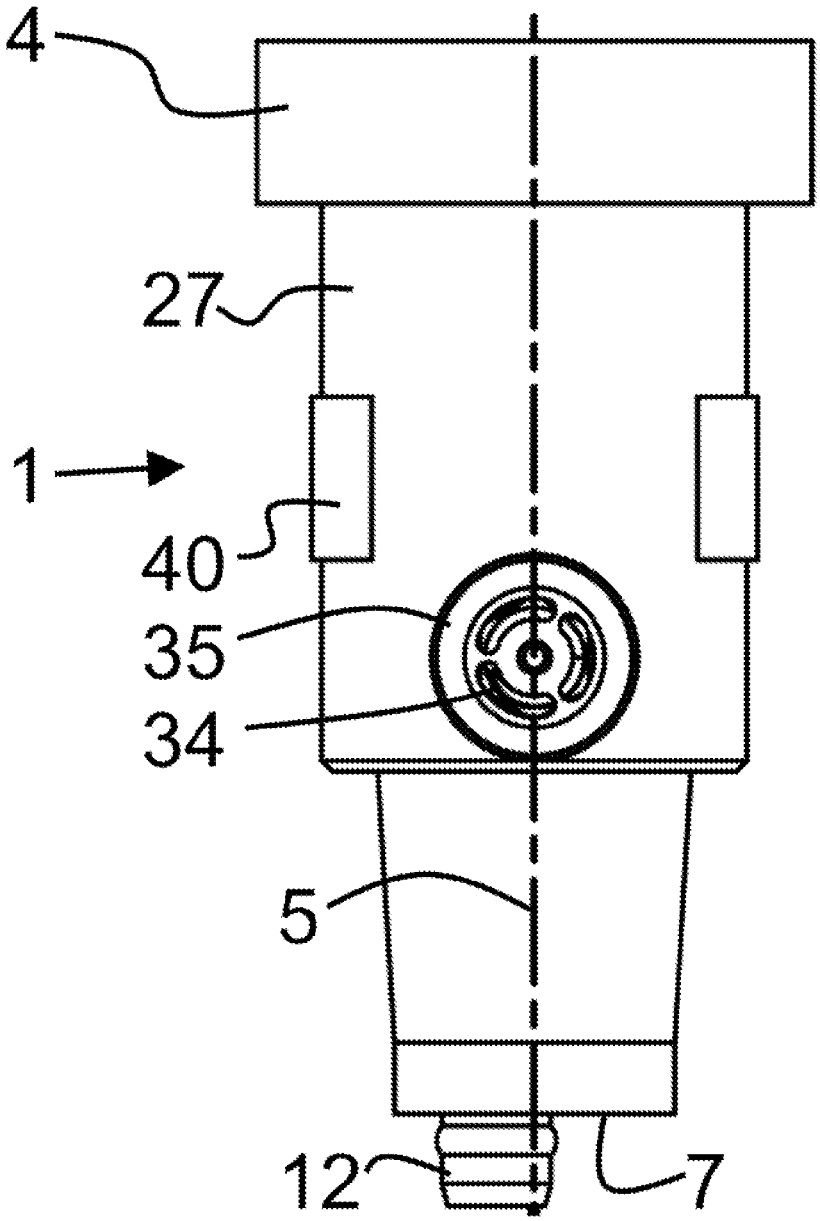
Figure 4:
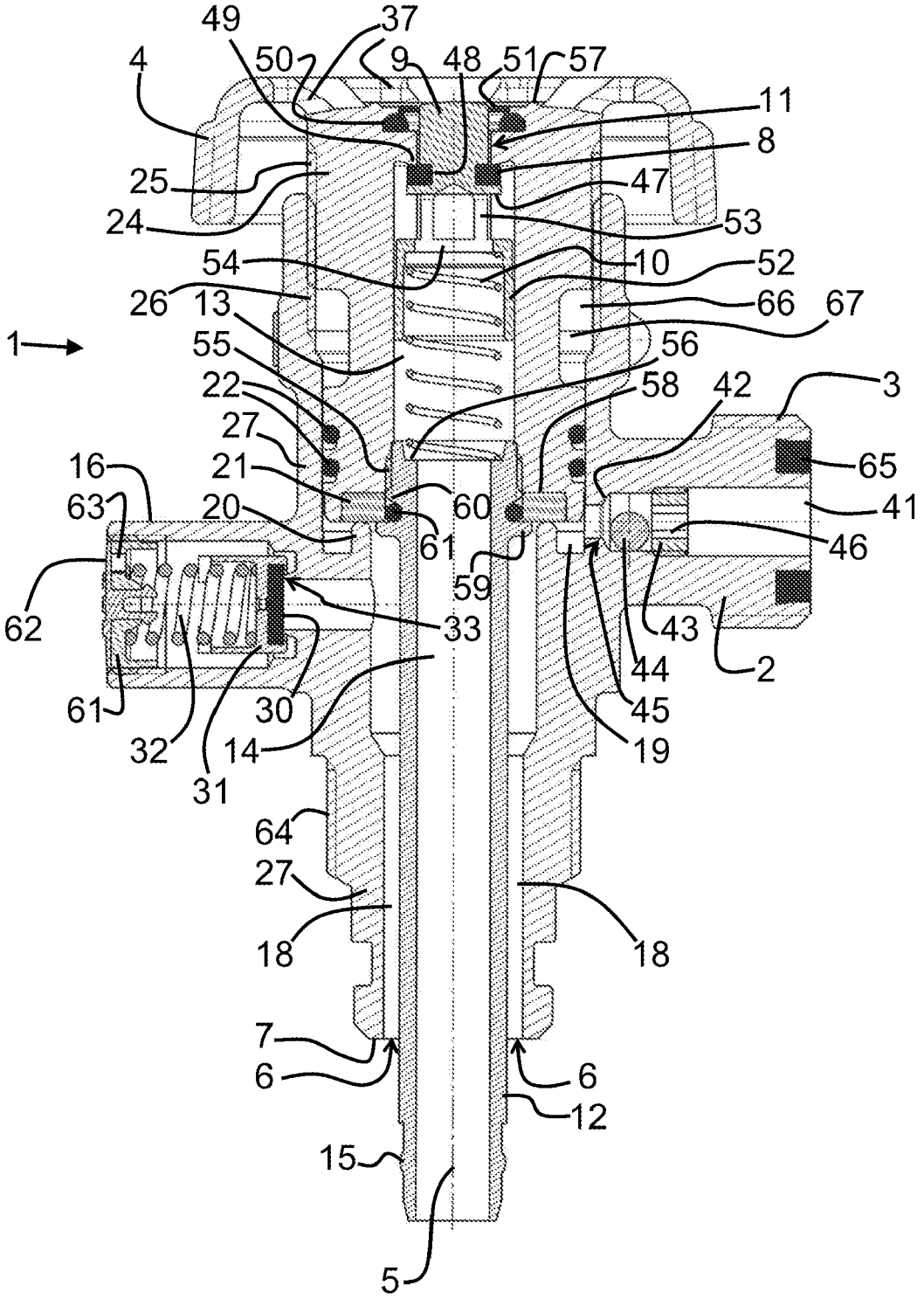
Figure 5:
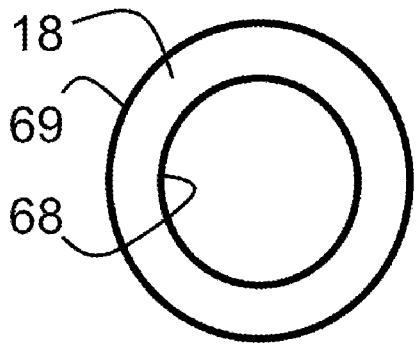

The pictures show:

FIG. 1: sectional view of a fitting;

FIG. 2: further sectional view of the fitting;

FIG. 3: side view of the fitting;

FIG. 4: sectional view through a further configuration of a fitting;

FIG. 5: sectional view through a gas supply channel.

FIG. 1 shows a sectional view of a fitting 1 for a gas bottle. The fitting 1 comprises a gas consumer connection piece 2 of common design. The gas consumer connection piece 2 is provided with a thread 3. A gas consumer such as a gas burner or a gas heater can be connected to the gas consumer connection piece 2. Gas from a gas bottle connected to the fitting 1 can be fed to the gas consumer via the gas consumer connection piece 2 when a gas consumer is connected.

On the upper side of the fitting 1 there is a rotary handle in the form of a rotating hand wheel 4. By opening or turning hand wheel 4 by rotation around the axis 5, the fitting 1 can be opened or closed. When the fitting 1 is open, gas from a gas bottle connected to the fitting 1 can flow through one or more gas inlet openings 6 at the underside 7 to a gas consumer connected to the gas consumer connection piece 2. When the fitting 1 is closed, no gas from a gas bottle connected to fitting 1 can flow through the fitting 1 to a gas consumer connected to the gas consumer connection piece 2.

On the upper side of the fitting there is a closure composed of two components 8 and 9, which in the unloaded state is pressed by the force of a pretensioned spring 10 against an opening edge 11, i.e. the edge of an opening, on the upper side of fitting 1 in a gas-tight manner. Component 8 is a circumferential sealing body, which preferably consists of an elastomer. The circumferential sealing body 8 is held in a form-fit manner by a mandrel of component 9, which consists of metal, for example. Component 9 is part of the closure and is therefore also called closure body 9. The circumferential sealing body 8 also rests with its underside on component 9. Component 9 also extends into the spiral spring 10 and is thus held in place in a clamping manner by the spring 10. If the closure 8, 9 is pressed down against the force of the pretensioned spring 10, the opening is opened. This opening is connected to a riser connection piece 12 located on the underside by a filling channel 13, 14 in a gas-conducting manner. The filling channel comprises an upper portion 13, which is widened with respect to a lower portion 14. The pretensioned spring 10 is located in the widened portion 13 of the filling channel. The lower end of the spring 10 is supported by the bottom of the portion 13. The upper end of the spring 10 is supported against a widened portion 9.

Gas can flow through the opening edge 11 towards the riser connection piece 12 and out of riser connection piece 12 when the closure 8, 9 has been pushed down to an open position. Conversely, gas can then also be pumped out of a gas bottle connected to fitting 1 through riser connection piece 12 when closure 8, 9 is open. Gas can therefore be pumped out through the opening on the upper side of fitting 1 in the opened state of closure 8, 9, to empty a gas bottle connected to fitting 1.

The riser connection piece 12 is designed and configured to connect a riser pipe or hose which reaches to the bottom of a connected gas bottle. The riser connection piece 12 protrudes downward from the gas-inlet underside 7. In order to be able to reliably connect a riser or a hose to riser connection piece 12, the outer circumference of riser connection piece 12 has a circular bulge 15 arranged annularly around riser connection piece 12, which bulge is in section in the shape of a partial circle.

Opposite the gas consumer connection piece 2 there is a pressure relief valve piece 16. Fitting 1 has an annular inner channel 17 which allows gas to flow from a right-hand gas supply channel 18 to the left-hand gas consumer connection piece when the handwheel 4 is in an opened position. However, two gas supply channels 18 can also be provided, for example. The gas supply channel 18 leads from the one or more gas inlet openings 6 to the right-hand region of the annular inner channel 17. An annular outer channel 19 runs parallel to the annular inner channel 17 and around the outside of the annular inner channel 17. The annular outer channel 19 is separated from the annular inner channel 17 by an annular wall 20. The annular wall 20 therefore forms the outer wall of the annular inner channel 17 and also the inner wall of the annular outer channel 19. On the left side the annular outer channel 19 is connected to the gas consumer connection piece 2 in a gas conducting manner so that gas from the annular outer channel 19 can flow through the gas consumer connection piece 2 and then on to a gas consumer connected to the gas consumer connection piece 2.

A sealing ring 21 with a flat underside is located in a recess on the underside of handwheel 4. When the handwheel 4 is in its closed position as shown in FIG. 1, the flat underside of the sealing ring 21 rests gastight on the upper side of the annular wall 20. The upper side of the annular wall 20 is rounded to reliably ensure a gas-tight connection. Because the sealing ring 21 has a flat underside and the upper side of the annular wall 20 is rounded, the thickness of the annular wall 20 can be advantageously small. This allows installation space advantages to be achieved.

Gas cannot pass from the annular inner channel 17 into the annular outer channel 19 if the underside of the sealing ring 21 rests on the upper side of the annular wall 20 in a gas-tight manner. This prevents gas from flowing from a gas bottle connected to the fitting 1 to the gas consumer connection piece 2 when the handwheel 4 is closed.

When the handwheel 4 is opened, the sealing ring 21 is lifted off the annular wall 20, i.e. moved away upwards. Subsequently, gas can flow from the annular inner channel 17 into the annular outer channel 19 and from here further into the gas consumer connection piece 2.

The handwheel 4 is sealed in a gas-tight manner by one or preferably several further outer sealing rings 22, preferably of round cross-section, in such a way that gas cannot escape from the annular outer channel 19 upwards out of the fitting. Several sealing rings 22 are preferable, since no gas should escape in an unplanned manner, in order to avoid unplanned emptying of a gas bottle. The handwheel 4 is sealed in a gas-tight manner by a further inner sealing ring 23, preferably of round cross-section, in such a way that gas cannot flow upwards from the annular inner channel 17 into the upper portion 13 of the filling channel. As a rule, one sealing ring 23 is sufficient, as it may be undesirable for gas to flow into the filling channel due to a leaking sealing ring 23, but this does not lead to an unplanned emptying of a gas bottle.

The handwheel 4 comprises an inner cylinder 24, which has an external thread 25 in an upper region. The aforementioned sealing rings 22 and 23 adjoin this inner cylinder 24 in a gas-tight manner on the inside and outside, respectively. The inner cylinder 24 has, for example, one or more circumferential recesses on its outside, in which one or more sealing rings 22 are held. The external thread 25 of the inner cylinder 24 is screwed into an internal thread 26 of a fitting housing 27. A retaining ring 28 is held by an inner circumferential recess in the fitting housing 27, which extends inwardly into a recess 29. The recess 29 is provided circumferentially on the outer circumference of the inner cylinder 24. The recess 29 is wider than the width of the retaining ring 28, so that the retaining ring 28 can be moved along the width of the recess 29 in the form of a relative movement. This limits movement of the handwheel 4 both in the direction of the closed position and in the direction of the open position. The retaining ring thus prevents the fitting 1 from being unscrewed. The path for opening the fitting is limited.

The fitting housing 27 is made of metal in one piece, namely machined from a metal block, for example by drilling and milling. The fitting housing therefore consists of a single piece. Thus, several parts were not first manufactured and subsequently joined together in such a way that they form the fitting housing 27.

The lower portion 14 of the gas conducting connection 13, 14, which connects the closable opening on the upper side with the opening at the underside 7, is formed by the fitting housing 27. Thus, the fitting housing 27 comprises a tube forming the lower portion 14. The fitting housing 27 comprises the underside 7 of the fitting. The gas consumer connection piece 2, the pressure relief valve piece 16 and the riser connection piece 12 are also part of the fitting housing 27.

In the pressure relief valve piece 16, there is a valve which opens in the event of an excessively high overpressure. The valve comprises a circular valve seal 30 which is held in place by a valve cover 31. The circular valve seal 30 may consist of an elastomer to effect a good sealing effect. The valve cover 31 is pressed by a preloaded valve spring 32 in the direction of an annular opening edge 33. The opening with the annular opening edge 33 is thus sealed gas-tight by the valve seal 30 when there is no excessively high overpressure. In the event of excessively high overpressure, the valve cover 31 is lifted off the opening edge 32 together with the valve seal 30 in such a way that gas can escape to the outside. The outer end of the valve spring 32 is held by a cover 35 provided with recesses 34. The cover 35 is attached to the pressure relief valve piece 16, for example by a screw connection. The cover 35 has recesses 34 to allow gas to escape through the cover 35 in the event of an excessively high overpressure.

The inner cylinder 24 of the handwheel 4 opens into a cap 36 on the upper side. The cap 36 has on its upper side a recess formed by ridges 37 to make it easier for a tool to open or close the handwheel 4 by rotation in an automated manner. It also facilitates automated refilling, since a filling head of a filling station can be more easily connected to the fitting.

Adjacent to the underside 7 is an interior space 38, which is formed around the lower portion 18 of the filling channel. An external filling protection is located in the interior space. The external filling protection 39 prevents the gas bottle from being filled through the gas consumer connection piece 2. The external filling protection 39 functions like a check valve.

FIG. 2 shows a section through fitting 1 rotated by 90° about axis 5 compared to FIG. 1. FIG. 3 shows a side view of fitting 1. There are two lateral box-shaped extensions 40. These make it easier to attach a fitting 1 to a gas bottle by means of tools.

FIG. 4 shows a sectional view of a further configuration of a fitting 1 for a gas bottle. In particular, differences from the previously described configuration are explained below.

A channel 41 leading into the connection piece 2 preferably has a funnel-shaped tapering 42. A ring 43 or a sleeve is inserted into the channel 41 of the connection piece 2 and is firmly attached thereto. For a fixed connection, the ring 43 or the sleeve can have an external thread which is screwed into an internal thread of the connection piece 2. However, the ring 43 or the sleeve can also be fastened in other ways within the channel 41, such as, for example, by a material fit.

A ball 44 is located between the inserted ring 43 or an inserted sleeve on the one hand and the funnel-shaped tapering 42 on the other. The diameter of the funnel bottom 45 of the funnel-shaped tapering 42 is smaller than the diameter of the ball 44. The diameter of the ball 44 is larger than the inside diameter of the ring 43 or sleeve. The inner diameter of the channel 41 is larger than the diameter of the ball 44. The distance between the bottom 45 of the funnel-shaped tapering 42 and the ring 43 is larger than the diameter of the ball 44. Thus, the ball 44 is movably held between the bottom 45 of the funnel-shaped tapering 42 and the ring 43. The ball 44 can close the funnel-shaped tapering 42, preferably in a gas-tight manner. This ensures that liquefied gas can be reliably and quickly pumped out of a gas bottle through the filling channel 13, 14 even if the rotary handle 4 has not been completely closed or a corresponding sealing problem exists. In this case, the ball 44 will be sucked toward the funnel bottom 45 by pumping until the ball 44 closes the funnel-shaped tapering 42. In addition, the ball 44 can prevent unplanned filling of a gas bottle through the connection piece 2. It then serves as external filling protection.

The ring 43 may have grooves 46 on the inner circumference that extend and are arranged such that the ball 44 cannot seal the ring 43 in a gas-tight manner. Grooves 46 run, for example, parallel to the channel 41 from an end face of the ring 43 to the opposite end face of the ring 43. However, grooves 46 can also run, for example, in a helical shape from one end face of the ring 43 to the opposite end face of the ring 43. The same applies if a sleeve is used instead of a ring.

The ball 44 may consist of a plastic material. The ball 44 may consist of an elastomer. The ball 44 may comprise a surface of an elastic material and otherwise consist of another material such as metal. The aforementioned materials can provide a good sealing effect. However, the ball may also consist entirely of metal.

The ring 43 or the sleeve preferably consist of metal. Installation parts 43, 44, which are installed in the gas consumer connection piece 2, can be mounted independently of other assembly steps in terms of time.

On the upper side of the fitting 1 there is a closure body 9 consisting in particular of metal. The closure body 9 preferably has a flange-shaped widening 47. An annular sealing body 8 can be seated on the flange-shaped widening 47. The annular sealing body 8 can be held in a form-fit manner in an annular recess 48 of the closure body 9. The sealing body 8 preferably consists of an elastomer.

In the unloaded state, the sealing body 8 is pressed gas-tight against a lower annularly extending edge 49 of the opening edge 11 by the force of the prestressed spring 10, which preferably consists of metal. The upper side of the sealing body 8 is therefore preferably flat so that reliable sealing in a gas-tight manner is enabled. Thus, the sealing body 8 can be rectangular or square in section so that particularly reliable sealing in a gas-tight manner is enabled.

In contrast to the configuration shown in FIG. 1, the closure body 8 cannot be reached from the outside and is therefore particularly well protected from damage and contamination. Compared to the configuration shown in FIG. 1, this configuration also has the advantage that the closure body 9 can be guided in an improved manner by the opening edge 11.

In order for the opening edge 11 to be able to guide the closure body 9 particularly reliably, its inner wall is preferably hollow cylindrical as shown in FIG. 4. The outer wall of the closure body 9 adjacent to the inner wall is preferably cylindrical in order to be guided particularly reliably.

A further annular sealing body 50 is preferably seated on a step at the upper side of the opening edge 11 and is held in an annular recess of the handwheel 4. An annular sealing lip 51 of the further annular sealing body 50 bears in particular tightly against the closure body 9 when the closure body 9 is in its closed position as shown in FIG. 4, i.e. not in its open position. Advantageously, this protects the closure 8, 9, in particular in the region of its guide through the opening edge 11, from contamination. As a result, trouble-free operation is particularly reliably ensured.

The annular sealing body 50, like any sealing body, preferably also consists of an elastomer or another sufficiently flexible plastic material to be able to seal reliably.

The closure body 9 preferably comprises a cap-like end piece 52 on its underside. The cap-like end piece 52 is preferably connected to the upper region of the closure body 9 via one or more ridges 53, and preferably in one piece. In particular, the one or more ridges 53 are connected to the flange-shaped widening 47. One-piece means that one piece has been manufactured. Thus, several pieces have not been manufactured in order to subsequently connect them to each other.

The spring 10, which preferably consists of metal, can extend into the cap-like end piece 52. In this way, the extending end of the spring 10 is held particularly reliably and securely. The cap-like end piece 52 may also be of technical use beyond this, which will be described below.

The cap-like end piece 52 preferably has a cylinder-like circumferential surface at least in sections in order to be guided particularly reliably.

The cap-like end piece 52 preferably has an opening 54 on the upper end face. As shown in FIG. 4, the diameter of the opening 54 is preferably smaller than the inner diameter of the circumferential surface. A wall section is then available at the end face at the edge region against which the spring 10 can rest. The opposite end face of the cap-like end piece 52 preferably has no such wall section, so that the spring 10 can be inserted unhindered into the cap-like end piece 52. The outer diameter of the spring 10 then preferably corresponds to the inner diameter of the cap-like end piece 52, as shown in FIG. 4.

However, the upper end face of the cap-like end piece 52 can also comprise, for example, a grid against which the spring 10 can rest.

The upper and lower end faces of the cap-like end piece 52 are preferably gas-permeable, so that gas can flow through the cap-like end piece 52. In the event of pumping, gas then flows through the cap-like end piece 52 and subsequently, for example, through the openings between the ridges 53 when the handwheel is opened.

The outer circumference of the cap-like end piece 52 preferably adjoins the inner wall of the filling channel 13, 14, namely in the region of its upper portion 13, whereby the closure body 9 can be alternatively or additionally guided.

The lower portion 14 of the filling channel 13, 14 is formed by the riser connection piece 12. The riser connection piece 12 is preferably, in contrast to the preceding exemplary embodiment, an independent component which has not been manufactured integrally with the fitting housing 27. In particular, the riser connection piece 12 is manufactured in one piece and preferably consists of metal.

If the closure body 9 is pressed down to the maximum extent, the lower edge of the cap-like end piece 52 preferably rests on an upper edge of the riser connection piece 12. The riser connection piece 12 thus serves as a stop to limit the movement of the closure 8, 9 into the fitting 1. In this embodiment, the length of the cap-like end piece 52 is selected such that the spring 10 can be completely accommodated in the interior space of the cap-like end piece 52. The spring 10 is thus particularly reliably protected from mechanical damage.

In a technically simple configuration, the riser connection piece 12 is preferably connected to the inner cylinder 24 of the handwheel 4 by a threaded connection 55. The riser connection piece 12 then has an external thread, for example, which is screwed into an internal thread of the inner cylinder 24. However, the riser connection piece 12 can also be connected to the inner cylinder 24 in other ways in a form-fit, force-fit and/or material-fit manner.

In one embodiment, the end of the riser connection piece 12 connected to the inner cylinder 24 has an annular step 56. The lower end of the spring 10 is retained in the step 56. The diameter of the spring 10 is matched to the diameter of the step 56 such that the lower end of the spring 10 can be retained in the step.

For assembly, in a preferred embodiment, the closure 8, 9 together with the spring 10 are first inserted from below into the inner cylinder 24 of the handwheel 4 as intended before the riser connection piece 12 is connected, for example screwed, to the inner cylinder 24.

In order for a sealing ring of a device of a filling station provided for this purpose to be reliably placed tightly on the upper side of the fitting for filling a gas bottle, the handwheel 4 preferably has an annular, upward-pointing projection 57. The diameter of the projection 57 corresponds to the diameter of the sealing ring of the device of a filling station provided for this purpose.

In a technically simple embodiment, the fitting 1 may comprise a preferably annular outer channel 19 which may extend around the gas supply channel 18. From the outer channel 19, gas can flow to the gas consumer connection piece 2, namely into the channel 41. The gas consumer connection piece 2 is therefore preferably adjacent to the outer channel 19 in order to keep the installation space and material requirements low. FIG. 4 shows the closed position of the handwheel 4. No gas can then flow from the gas supply channel 18 into the outer channel 19. This is prevented by a sealing ring 21, which is pressed in a gas-tight manner against an annular wall 20 from above by the inner cylinder 24. The annular wall 20 separates the outer channel 19 from the gas supply channel 18.

The sealing ring 21 is preferably located in an annular, step-shaped recess 58 on the underside of the inner cylinder 24. In this annular recess 58, the annular seal 58 is held in a loss-proof manner by the riser connection piece 12. For a loss-proof retention, the riser connection piece has, for example, a circumferential flange 59 which bears against the annular seal 21.

Above the circumferential flange 59, the riser connection piece 12 preferably has a recess 60 in which a further sealing ring 61 is held. This further sealing ring 61 achieves in an improved manner that the inner cylinder 24 is connected in a gas-tight manner to the riser connection piece 12 with little technical effort in order to obtain a gas-tight filling channel 13, 14. The two sealing rings 21 and 61 bear in a gas-tight manner against each other. The sealing rings 21, 61 can advantageously have different cross sections. For example, one sealing ring 21 expediently has a rectangular cross-section and the other further sealing ring 61 has a round cross-section. Both sealing rings 21, 61 are held in a loss-proof manner by the inner cylinder 24 and the riser connection piece 12.

Instead of two sealing rings 21, 61, however, a one-piece sealing ring can also be provided, which can also be manufactured in one piece. For manufacturing and geometrical reasons, however, it may be advantageous to provide two sealing rings 20, 61.

For assembly, the one or more sealing rings 20, 61 are preferably first inserted in recesses 58, 60 provided for this purpose before the handwheel 4 is connected to the riser connection piece 12. Once the handwheel 4 has been connected to the riser connection piece 12, the handwheel 4 can be screwed into the fitting housing 27, provided that further sealing rings 22, if necessary for operation, have been mounted to the inner cylinder 24 of the handwheel 4 as intended.

The annular wall 20 of the outer channel 19 is preferably part of the housing 27 of the fitting 1. The housing 27 of the fitting 1 is in particular a single piece. In this case, therefore, the annular wall 20 is also integrally connected to the remaining part of the fitting housing 27.

As shown in FIG. 5, the gas supply channel 18 is preferably annular in section in order to keep installation space, material costs and the flow resistance for gas low. This means that the gas supply channel 18 is located between a cross-sectionally annular inner wall 68 and a cross-sectionally annular outer wall 69. The inner wall of the gas supply channel 18, which is cylindrical for example, is then preferably formed by the riser connection piece 12. The outer wall of the gas supply channel 18 is then preferably part of the fitting housing 27. The gas supply channel 18 can thus be formed by the fitting housing 27 and the riser connection piece 12 with a small installation space and a small amount of material.

A valve body 61, which comprises an elastic diaphragm 62, is screwed into the pressure relief valve piece 16. The diaphragm 62 closes an opening 63 leading into the pressure relief valve piece 16. In the event of overpressure, the diaphragm 62 is lifted off the opening 63 and gas can escape to the outside. The membrane 62 protects the interior space of the pressure relief valve piece 16 against contamination.

The valve spring 32 of the valve with the circular valve seal 30 is held by the valve body 61 in such a way that the spring 32 presses the valve cover together with the circular valve seal 30 against the opening edge 33 in a gas-tight manner. The pressure relief valve 16 thus comprises two valves which open when the internal pressure is too high.

The valves can be mounted in the pressure relief valve socket 16 irrespective of whether the handwheel has already been mounted or not.

By means of an external thread 64, the fitting 1 is screwed to the opening of a gas bottle.

The end face of the gas consumer connection piece 2 can have an annular recess in which an annular seal 65 is inserted. The ring seal 65 enables a gas consumer to be connected in a gas-tight manner particularly reliably.

A securing means may be provided to prevent the handwheel from being completely unscrewed in an unplanned manner. The inner cylinder 24 can have a, for example, circumferential recess 66 on its outer side, which can be part of the securing means. A bolt 67 may extend into this recess 66 in such a way as to prevent unplanned complete unscrewing of the handwheel 4. The bolt 67 may be part of a screw which passes through the fitting housing 27 and which is accessible from the outside for the purpose of assembly and disassembly.

In the configuration shown in FIG. 4, movement of the handwheel 4 is transmitted to the riser connection piece 12 as the riser connection piece 12 is fixedly connected to the handwheel 4.

The configuration shown in FIG. 4 can be manufactured and assembled with particularly little effort. The required installation space can nevertheless be kept small.

The invention claimed is:

1. A fitting for a liquid gas bottle with a gas consumer connection piece, with a gas inlet opening on an underside, with a first gas conducting connection between the gas inlet opening and the gas consumer connection piece, with a rotary handle, which can be turned into an open position and into a closed position, wherein in the open position gas can flow from the gas inlet opening to the gas consumer connection piece and in the closed position no gas can flow from the gas inlet opening to the gas consumer connection piece, with a closable opening on an upper side of the fitting, with a second gas conducting connection which connects the closable opening on the upper side with an opening at the underside in such a way that refilling a connected liquid gas bottle with gas through the underside and through the closable opening is possible, and wherein an edge of the closable opening is part of the rotary handle, wherein the closable opening comprises a closure body on the upper side of the fitting, and wherein a stroke movement of an inner cylinder is limited by a sealing ring which extends into a recess which is wider than the sealing ring so that the sealing ring can be moved along the recess.

2. The fitting according to claim 1, wherein the rotary handle comprises an inner cylinder forming a portion of the gas conducting connection which connects the closable opening on the upper side with the opening at the underside, wherein a closing device is provided in the inner cylinder with which the closable opening can be closed.

3. The fitting according to claim 2, wherein the inner cylinder separates an inner channel from an outer channel in a gas-tight manner when the rotary handle is in its closed position, wherein gas can flow from the inner channel into the outer channel, when the rotary handle is in its open position, wherein gas can flow from the gas inlet opening along a gas supply channel into the inner channel and wherein gas can flow from the outer channel to the gas consumer connection piece.

4. The fitting according to claim 3, wherein the inner channel and outer channel extend annularly around the gas conducting connection which connects the closable opening on the upper side with the opening at the underside.

5. The fitting according to claim 3, wherein the gas supply channel is provided with a pressure relief valve through which gas can escape from the fitting in an event of excessively high gas pressure.

6. The fitting according to claim 5, wherein the pressure relief valve is arranged on a side of the fitting which is opposite the gas consumer connection piece.

7. The fitting according to claim 1, wherein a riser connection piece protrudes from the underside and gas can flow through the riser connection piece to the closer connection piece to the closable opening.

8. The fitting according to claim 1, wherein the underside is bordered by an interior space in which gas deflection plate is provided.

9. The fitting according to claim 1, wherein one or more additional sealing rings are provided between the inner cylinder and a fitting housing which inwardly and/or outwardly borders the inner cylinder, wherein the one or more additional sealing rings are held in respective one or more additional recesses, wherein the one or more additional sealing rings are pressed against the inner cylinder in a gas-tight manner.

10. The fitting according to claim 1, wherein a fitting housing is made of metal in one piece.

11. The fitting according to claim 10, wherein the rotary handle is rotatably connected to the fitting housing by a threaded connection and a lower portion of the gas conducting connection which connects the closable opening on the upper side with the opening at the underside is formed by the fitting housing.

12. The fitting according to claim 11, wherein the gas consumer connection piece, a pressure relief valve piece and/or a riser connection piece are part of the fitting housing.

13. The fitting according to claim 10, wherein the fitting housing comprises the underside.

14. The fitting according to claim 1, wherein the rotary handle is a cap with a funnel-like hollow and the closable opening is provided in the base of the hollow.

15. The fitting according to claim 1, wherein a gas supply channel having an inner wall is provided, wherein the inner wall is the wall of a riser connection piece through which gas can flow, and the riser connection piece is a separate component.

16. The fitting according to claim 1, wherein a gas supply channel with an outer wall is provided, wherein the outer wall is part of the fitting housing.

17. The fitting according to claim 1, wherein a closure body for closing the closable opening is provided on the upper side of the fitting, the closure body comprising a cap-like end piece into which a spring extends.

18. The fitting according to claim 1, wherein the gas consumer connection piece comprises an external filling protection.

19. The fitting according to claim 1, wherein an external filling protection comprises a funnel and a ball for closing the funnel.

20. A fitting for a liquid gas bottle with a gas consumer connection piece, with a gas inlet opening on an underside, with a first gas conducting connection between the gas inlet opening and the gas consumer connection piece, with a rotary handle, which can be turned into an open position and into a closed position, wherein in the open position gas can flow from the gas inlet opening to the gas consumer connection piece and in the closed position no gas can flow from the gas inlet opening to the gas consumer connection piece, with a closable opening on an upper side of the fitting, with a second gas conducting connection which connects the closable opening on the upper side with an opening at the underside in such a way that refilling a connected liquid gas bottle with gas through the underside and through the closable opening is possible, and wherein an edge of the closable opening is part of the rotary handle, wherein the rotary handle is fixedly connected to a riser connection piece, wherein the riser connection piece extends to the underside of the fitting and gas is able to flow through the riser connection piece.

21. A fitting for a liquid gas bottle with a gas consumer connection piece, with a gas inlet opening on an underside, with a first gas conducting connection between the gas inlet opening and the gas consumer connection piece, with a rotary handle, which can be turned into an open position and into a closed position, wherein in the open position gas can flow from the gas inlet opening to the gas consumer connection piece and in the closed position no gas can flow from the gas inlet opening to the gas consumer connection piece, with a closable opening on an upper side of the fitting, with a second gas conducting connection which connects the closable opening on the upper side with an opening at the underside in such a way that refilling a connected liquid gas bottle with gas through the underside and through the closable opening is possible, and wherein an edge of the closable opening is part of the rotary handle, wherein a riser connection piece extends to the underside of the fitting and said riser connection piece forms a stop for a closure body with which the closable opening on the upper side of the fitting can be closed.

22. A fitting for a liquid gas bottle with a gas consumer connection piece, with a gas inlet opening on an underside, with a first gas conducting connection between the gas inlet opening and the gas consumer connection piece, with a rotary handle, which can be turned into an open position and into a closed position, wherein in the open position gas can flow from the gas inlet opening to the gas consumer connection piece and in the closed position no gas can flow from the gas inlet opening to the gas consumer connection piece, with a closable opening on an upper side of the fitting, with a second gas conducting connection which connects the closable opening on the upper side with an opening at the underside in such a way that refilling a connected liquid gas bottle with gas through the underside and through the closable opening is possible, and wherein an edge of the closable opening is part of the rotary handle, wherein a gas supply channel is provided through which gas can flow from the underside of the fitting to the gas consumer connection piece and the gas supply channel is located between an inner wall which is annular in section and an outer wall which is annular in section.

* * * * *